US007863776B2

(12) United States Patent
Togami et al.

(10) Patent No.: US 7,863,776 B2
(45) Date of Patent: Jan. 4, 2011

(54) TRANSCEIVER CONNECTOR WITH INTEGRATED MAGNETICS

(75) Inventors: Chris Togami, San Jose, CA (US); Andy Engel, Portola Valley, CA (US)

(73) Assignee: Finisar Corporation, Sunnyvale, CA (US)

( * ) Notice: Subject to any disclaimer, the term of this patent is extended or adjusted under 35 U.S.C. 154(b) by 235 days.

(21) Appl. No.: 12/060,552

(22) Filed: Apr. 1, 2008

(65) Prior Publication Data

US 2008/0248694 A1 Oct. 9, 2008

Related U.S. Application Data

(60) Provisional application No. 60/909,987, filed on Apr. 4, 2007.

(51) Int. Cl.
*H01F 27/42* (2006.01)

(52) U.S. Cl. ..... 307/104

(58) Field of Classification Search ..... 307/104
See application file for complete search history.

(56) References Cited

U.S. PATENT DOCUMENTS

| | | | | |
|---|---|---|---|---|
| 5,587,884 | A * | 12/1996 | Raman | 361/728 |
| 6,227,911 | B1 * | 5/2001 | Boutros et al. | 439/620.18 |
| 6,302,741 | B1 * | 10/2001 | Fasold et al. | 439/620.19 |
| 6,848,943 | B2 * | 2/2005 | Machado et al. | 439/607.01 |
| 7,186,134 | B2 * | 3/2007 | Togami et al. | 439/484 |
| 7,517,254 | B2 * | 4/2009 | Zhang et al. | 439/668 |
| 2004/0161958 | A1 | 8/2004 | Togami | |

* cited by examiner

*Primary Examiner*—Robert L. Deberadinis
(74) *Attorney, Agent, or Firm*—Workman Nydegger

(57) ABSTRACT

In one example embodiment, a connector structure includes a housing that defines a chamber, a plurality of magnetic cores positioned within the chamber, and a means for positioning the plurality of magnetic cores so that a first magnetic core of the plurality of magnetic cores is not in physical contact with a second magnetic core of the plurality of magnetic cores.

19 Claims, 4 Drawing Sheets

TRANSCEIVER CONNECTOR WITH INTEGRATED MAGNETICS

CROSS REFERENCE TO A RELATED APPLICATION

The present application claims priority to U.S. Provisional Patent Application Ser. No. 60/909,987, filed Apr. 4, 2007 and entitled "TRANSCEIVER CONNECTOR WITH INTEGRATED MAGNETICS," which is incorporated herein by reference in its entirety.

BACKGROUND

Small Form-factor Pluggable (SFP) transceiver modules are relatively small, hot-swappable devices that can be plugged into a variety of host networking equipment. The portions of optical SFP transceiver modules and electrical SFP transceiver modules that are configured to be received inside a host port ("the host port portion") both conform to the SFP Transceiver Multi-Source Agreement (MSA), which is incorporated herein by reference in its entirety. The SFP Transceiver MSA specifies, among other things, package dimensions for the host port portions of such transceiver modules. Specifically, the Appendix A.A1 of the SFP Transceiver MSA specifies package dimensions for SFP transceiver modules. The conformity of the host port portions of the electrical and optical SFP transceiver modules, with respect to package dimensions and host interface configurations, allows an optical SFP transceiver module to be replaced by an electrical SFP transceiver module without affecting the operation of the host networking equipment. This interchangeability between electrical and optical SFP transceiver modules allows for flexibility in a communications network that includes both electrical and optical cabling.

The dimensional conformity required by the SFP Transceiver MSA creates some limitations, however, for electrical SFP transceiver module design. Specifically, dimensional conformity of the host port portion required by the SFP Transceiver MSA defines a finite volume within which components of the SFP transceiver module can be located. Among the components included in the host port portion of a typical electrical SFP transceiver module are one or more printed circuit boards and multiple magnetic cores. Each magnetic core acts as a transformer and a common-mode choke for electrical data signals passing through the electrical SFP transceiver module. Each magnetic core acts as a transformer by increasing or decreasing the voltage and current of electrical data signals passing through the magnetic core. Each magnetic core acts as a common-mode choke by reducing common mode electrical noise in the electrical data signals passing through the magnetic core.

The printed circuit boards generally include various electronic circuitry and components that provide functionality to the electrical SFP transceiver module. To the extent that relatively more space can be made available on the printed circuit boards, relatively more electronic circuitry and components and functionality can be included within the electrical SFP transceiver module.

In addition, electrical SFP transceiver module designs are continually being modified to enable transceiver operation over ever-larger temperature ranges. In response, the magnetic cores employed within the electrical SFP transceiver modules have correspondingly increased in size. For example, magnetic cores in an electrical SFP transceiver designed to operate within a −40° C. to 85° C. temperature range will generally be relatively larger in size than magnetic cores in an electrical SFP transceiver designed to operate within a 0° C. to 70° C. temperature range. Consequently, where more of the available space within an electrical SFP transceiver module is being utilized by larger magnetic cores, less space is available for the inclusion of desirable electronic components on the printed circuit boards of the electrical SFP transceiver module.

Furthermore, the relative placement of magnetic cores can be critical to transceiver performance. For example, magnetic cores that are positioned too close together in an electrical SFP transceiver module may cause an undesirably high bit error rate (BER) in the electrical SFP transceiver module. Although relatively precise placement of magnetic cores is required in order to achieve an acceptably low BER, the proper placement of magnetic cores within an electrical SFP transceiver module can be difficult due to the limited space within the electrical SFP transceiver module.

SUMMARY OF SOME EXAMPLE EMBODIMENTS

In general, example embodiments relate to an electrical module, such as an electrical transceiver or transponder module for example, that includes a connector structure for receiving the plug of a communication cable. In general, an electrical module operates without the use of optical or optoelectronic components, while an optical module operates using optical components. The disclosed electrical modules generally make use of magnetic cores that act as transformers and common-mode chokes for electrical data signals passing through the electrical module. Some example connector structures are configured to receive multiple magnetic cores during assembly such that accurate placement of the magnetic cores during assembly is simplified. This accurate placement of magnetic cores may contribute to a relative decrease in the bit error rate (BER) of the electrical module.

In one example embodiment, a connector structure includes a housing that defines a chamber, a plurality of magnetic cores positioned within the chamber, and a means for positioning the plurality of magnetic cores so that a first magnetic core of the plurality of magnetic cores is not in physical contact with a second magnetic core of the plurality of magnetic cores.

In another example embodiment, a connector structure includes a housing that defines a chamber, a plurality of magnetic cores positioned within the if chamber, and a structure positioned between a first magnetic core and a second magnetic core of the plurality of magnetic cores. The structure is configured such that the first magnetic core is not in physical contact with the second magnetic core.

In yet another example embodiment, an electrical transceiver module includes a base that includes a host port portion connected to a connector portion. The host port portion substantially complies with SFP Transceiver MSA package dimensions. The electrical transceiver module also includes a first printed circuit board positioned substantially within the host port portion and a connector structure positioned substantially within the connector portion. The connector structure includes a housing that defines a chamber, a plurality of magnetic cores positioned within the chamber, and a post positioned between a first magnetic core and a second magnetic core of the plurality of magnetic cores. The post is configured such that the first magnetic core is not in physical contact with the second magnetic core.

BRIEF DESCRIPTION OF THE DRAWINGS

To further clarify certain aspects of embodiments of the present invention, a more particular description will be rendered by reference to specific embodiments thereof which are disclosed in the appended drawings. It is appreciated that these drawings depict only example embodiments of the invention and are therefore not to be considered limiting of its scope. Aspects of example embodiments will be described and explained with additional specificity and detail through the use of the accompanying drawings in which.

DETAILED DESCRIPTION OF SOME EXAMPLE EMBODIMENTS

Example embodiments relate to an electrical module, such as an electrical transceiver or transponder module for example, that includes a connector structure for receiving the plug of a communication cable. Some example connector structures are configured to receive multiple magnetic cores during assembly such that accurate placement of the magnetic cores during assembly is simplified. Among other things, this accurate placement of magnetic cores may contribute to a relative decrease in the bit error rate (BER) of the electrical module.

The example connector structure is also configured to house a plurality of magnetic cores within the connector structure itself instead of on the one or more printed circuit boards of the electrical module, thereby making additional space available on one or more printed circuit boards. The additional space made available on the printed circuit board (s) can then be utilized for the inclusion of additional electronic components, thereby enhancing module performance and/or flexibility.

While described in the context of electrical modules used in the field of communications networking, it will be appreciated that example embodiments may be employed in other applications as well. For example, other types of electronic modules could utilize embodiments of the example connector structure disclosed herein.

I. Example Transceiver Module

Figure 1:
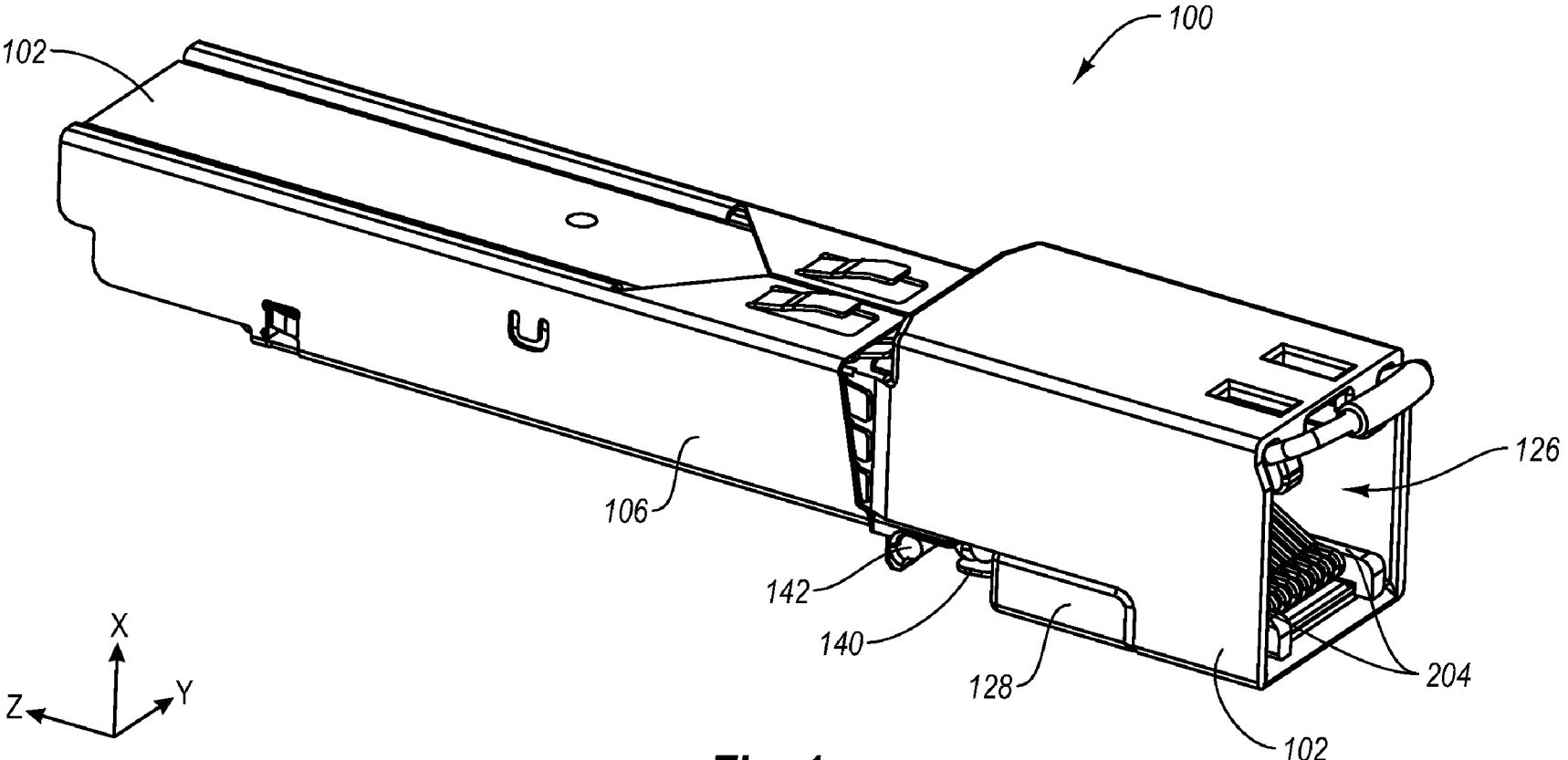
FIG. 1 is a perspective view of an example electrical transceiver module.
Figure 2:
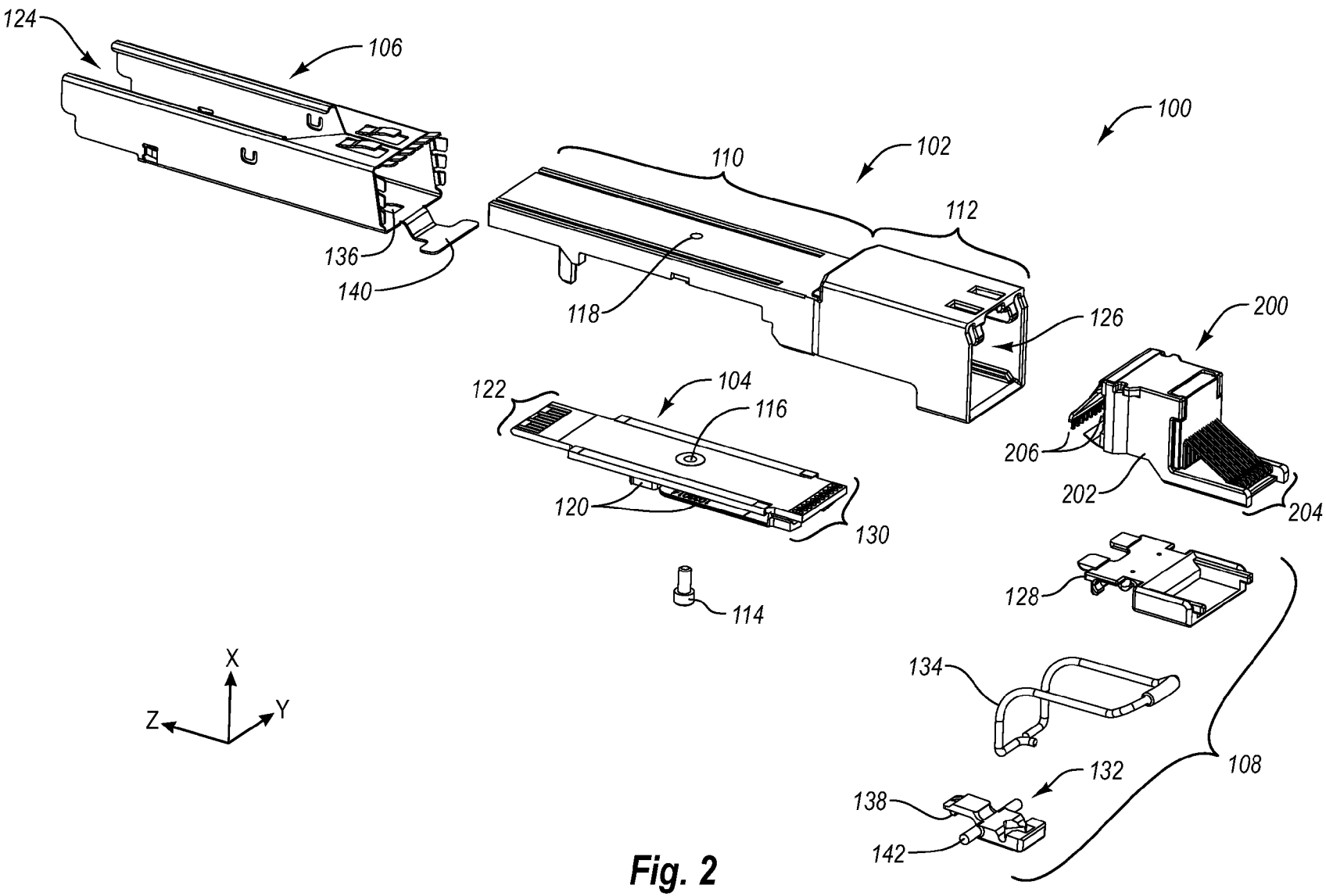
FIG. 2 is an exploded view of the example electrical transceiver module of FIG. 1.

Reference is first made to FIGS. 1 and 2 together, which disclose aspects of one example embodiment of an electrical transceiver module 100. A portion of the module 100 that is configured to be positioned within a host port (not shown) substantially complies with existing industry standards, including module form factor, specified in the SFP Transceiver MSA. Module 100 achieves a data rate of about 1.25 Gbit per second, supports the 1000Base-T transmission standard (also known as the IEEE 802.3ab standard), operates between about −40° C. and about 85° C., and is hot pluggable. Aspects of example embodiments can be implemented in transceiver modules having other data rates, transmission standards, and/or operating temperatures. For example, aspects of example embodiments can be implemented in transceiver modules configured for optical signal transmission and reception at a variety of per-second data rates including, but not limited to, 1 Gbit, 2 Gbit, 2.5 Gbit, 4 Gbit, 8 Gbit, 10 Gbit, 17 Gbit, 40 Gbit, 100 Gbit, or higher. Further, aspects of example embodiments can be implemented in transceiver modules configured to support various communication standards including, but not limited to, Fast Ethernet, Gigabit Ethernet, 10 Gigabit Ethernet, and 1×, 2×, 4×, and 10× Fibre Channel. Moreover, aspects of example embodiments can be implemented in transceiver modules configured to operate between about 0° C. and about 85° C. or between about 0° C. and about 70° C. Likewise, aspects of example embodiments can be implemented in transceiver modules that are not hot pluggable.

In the disclosed example, the module 100 includes a base 102, a first printed circuit board 104, a housing 106, a latch mechanism 108, and a connector structure 200. The base 102 may include a host port portion 100 and a connector portion 112. The host port portion 10 is configured to be removably received inside a port of a host device (not shown) and the connector portion 112 is configured to remain on the outside of the host device when the host port portion 10 of the module 100 is operably positioned within the port of the host device.

The housing 106 and the host port portion 110 of the base 102 are configured to partially enclose the first printed circuit board 104. The connector portion 112 of the base 102 is attached to the latch mechanism 108 and the connector structure 20. Each of the elements 102-108 and 200 of the example module 100 will now be described in turn.

The printed circuit board 104 can be secured to the base 102 with a fastener 114 which passes through an opening 116 in the printed circuit board 104 and into an opening 118 in the base 102. In this example, the printed circuit board 104 accommodates various electronic components 120 positioned thereon. The printed circuit board 104 can include various components and circuitry configurations, depending on the desired functionality for the module 100. Also formed on the printed circuit board 104 at a rear end is an exposed edge connector 122. The edge connector 122 is configured to physically and electrically interface with a corresponding electrical connector (not shown) that is positioned within the port of a host device (not shown).

FIGS. 1 and 2 also disclose that the host port portion 110 of the base 102 and the printed circuit board 104 can be at least partially enclosed and retained within the housing 106. The housing 106 is generally rectangular in cross-sectional shape so as to interface with the base 102. The housing 106 includes an opening 124 at a rear end that serves to expose the edge connector 122 of the printed circuit board 104 and thereby permit the edge connector 122 to be operatively received within a corresponding electrical connector (not shown) within a host port of a host device (not shown). In one example embodiment, the housing 106 is formed of a conductive material such as sheet metal.

In the disclosed embodiment, the connector portion 112 of the base 102 defines a receptacle 126 within which part of the connector structure 200 is positioned. The connector structure 200 is used for interfacing with a corresponding plug (not shown) of an electrical communications cable. Examples of receptacle and plug configurations include, but are not limited to, receptacles and plugs compliant with registered jack RJ) standards such as RJ45, RJ-11, RJ-14, RJ-25, RJ-48, and RJ-61. The RJ-45 standard is commonly used in conjunction with an electrical communications cable. Examples of electrical communications cables include, but are not limited to, Category 5 (CAT-5) cables, CAT-5e cables, and CAT-6 cables. It will be appreciated that the receptacle 126 and/or the connector structure 200 could be implemented to accommodate any one of a number of different connector configurations, depending on the particular application involved.

The connector structure 200 fits within receptacle 126 defined by the connector portion 112 of base 102. Together, the receptacle 126 and the connector structure 200 make up, in this example embodiment, an RJ-45 jack. The connector structure 200 is electrically connected to the printed circuit board 104 (discussed below).

The example connector structure 200 includes a molded housing 202 to which other components of the connector structure 200 are connected. The example connector structure 200 also includes a first set of conductive elements 204, each of which is configured to electrically connect with a corresponding electrical element of a plug, such as an RJ-45 plug (not shown) for example, when the RJ-45 plug is inserted into the receptacle 126. The connector structure 200 also includes a second set of conductive elements 206, each of which is electrically connected to a corresponding plated through hole 130 on the first printed circuit board 104.

With continuing reference to FIGS. 1 and 2, the latch mechanism 108 is made up of a pivot block 132, a bail 134, and the mounting plate 128. In one example embodiment, the latch mechanism 108 provides several functions. By way of example, the latch mechanism 108 provides a mechanism to aid in removable retention of the module 100 within a host port (not shown). Moreover, the latch mechanism 108 can be used to extract the module 100 from the host port, without the need for a special extraction tool.

The latch mechanism 108 may be implemented so as to substantially preserve the small form factor of module 100 in a manner that allows convenient insertion and extraction of the module 100 into/from a host port without disturbing adjacent modules or adjacent communications cables, even when the module 100 is used in a host having a high port density. Also, the latch mechanism 108 precludes inadvertent extraction of the module 100 from the host port when an RJ-45 plug is at least partially received within the receptacle 126.

With continued reference to the latch mechanism 108, the mounting plate 128 of the latch mechanism 108 is configured for use in operatively interconnecting the pivot block 132, the bail 134 and the module 100. The function of the pivot block 132 and the bail 134 with respect to the mounting plate 128 within the module 100 is substantially similar to the function and operation of a pivot block 310 and a bail 308 with respect to a mounting plate 314 within a module 300 disclosed in FIGS. 5 and 6 of U.S. Patent Application Publication No. "2004/0161958 A1" titled "Electronic Modules Having Integrated Lever-Activated Latching Mechanisms," published Aug. 19, 2004, which is incorporated herein by reference in its entirety.

The housing 106 is configured so as to accommodate the latch mechanism 108 of the module 100. For example, a bottom surface of the housing 106 includes a locking recess 136, which is sized and shaped to expose a locking pin 138 of the pivot block 132 when the latch mechanism 108 is assembled within the module 100 and when the latch mechanism 108 is placed in a latched position. Also, the housing 106 includes a resilient metal portion formed as a leaf spring 140. When the module 100 is assembled, the leaf spring 140 is biased against a top surface of the pivot block 132 so as to operatively secure the pivot block 132 in its assembled position. Also, the biasing action of the leaf spring 140 functions to urge the pivot block 132 in a rotational direction about a pivot point 142 such that the locking pin 138 extends through locking recess 136. When the locking pin 138 is extended through the locking recess 136 such that the locking pin 138 can engage with a port of a host device (not shown), the module 100 is in a latched position.

II. Example Connector Structure

Figure 3:
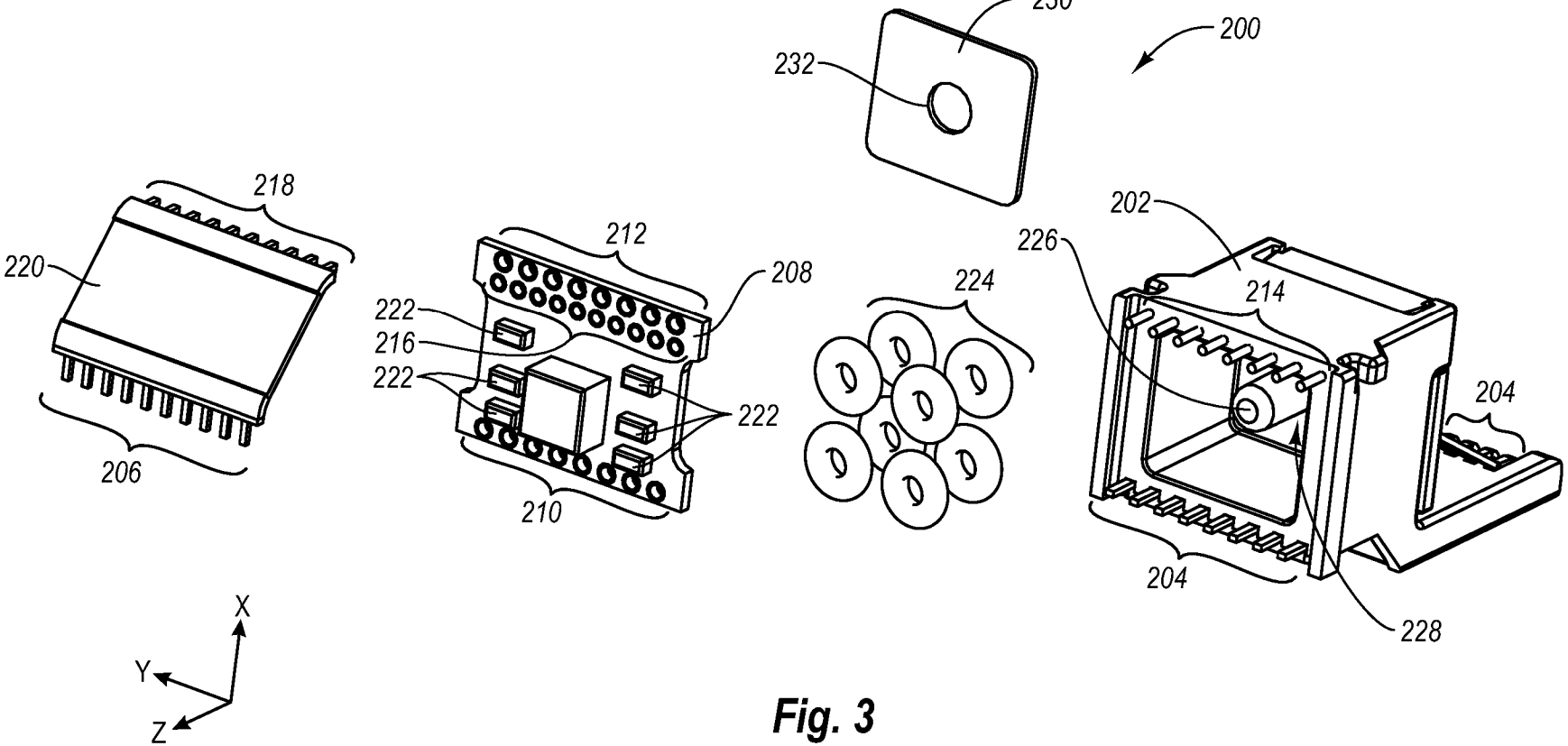
FIG. 3 is an exploded view of the connector structure of the example electrical transceiver module of FIGS. 1 and 2.

Reference is now made to FIG. 3 which discloses an exploded perspective view of a rear side of the example connector structure 200 of FIG. 2. As disclosed herein, the connector structure 200 includes a molded housing 202 to which other components of the connector structure 200 are connected. The connector structure also includes a first set of conductive elements 204 attached to the housing 202 and a second set of conductive elements 206 attached to the housing 202. The connector structure 200 further includes a second printed circuit board 208 that is sized and configured to be positioned on the rear side of the housing 202. The printed circuit board 208 includes a first set of plated through holes 210 that correspond to the first set of conductive elements 204. When the connector structure 200 is assembled, each of the conductive elements 204 is received by a respective one of the plated through holes 210 such that an electrical connection between each conductive element 204 and a corresponding plated through hole 210 is achieved.

The printed circuit board 208 also includes a second set of plated through holes 212 that correspond to a third set of conductive elements 214 of the connector structure 200. The printed circuit board 208 further includes a third set of plated through holes 216 that correspond to a fourth set of conductive elements 218 positioned on a flexible ribbon 220. When the connector structure 200 is assembled, each of the conductive elements 214 is received by a respective one of the plated through holes 212 such that an electrical connection between each conductive element and a corresponding plated through hole 212 is achieved. Similarly, each of the conductive elements 218 is received by a respective one of the plated through holes 216 such that an electrical connection between each conductive element 218 and a corresponding plated through hole 216 is achieved. The printed circuit board 208 also includes electronic circuitry 222 in electrical communication with one or more of the plated through holes 210, 212, and 216.

As noted earlier, and as disclosed in FIG. 2, the conductive elements 206 are configured in the present embodiment as pins that engage corresponding plated through holes 130 of the printed circuit board 104. The conductive elements 204, 206, 214, and 218, together with the corresponding plated through holes 210, 212, 216, and 130, along with the electronic components 222, the electronic components 120, and exposed edge connector 122, define a plurality of conductive pathways between an RJ-45 plug (not shown) received within the receptacle 126, and a host device (not shown) within which the module 100 is received.

The connector structure 200 also includes magnetic cores 224. The magnetic cores 224 act as transformers or common-mode chokes for electrical data signals passing through the connector structure 200. In one example embodiment, the magnetic cores 224 have a toroidal shape similar to the shape of a doughnut, but need not be so configured. Each magnetic core 224 includes one or more windings of, for example, copper or other conductive wire. As disclosed in FIG. 3, the housing 202 of the example connector structure 200 is configured to accommodate up to eight magnetic cores, although other configurations designed to accommodate more than eight magnetic cores or less than eight magnetic cores are contemplated as being within the scope of the present invention.

The connector structure 200 further includes a means for positioning the magnetic cores 200. One example of a structural implementation of a means for positioning the magnetic cores is a post 226. In one example embodiment, the post 226 is substantially centrally located within a chamber 228 that is defined in the rear side of the housing 202 of the connector structure 200. The post 226 need not be centrally located within the chamber, and could be positioned off-center in order to accommodate different sizes, numbers, and arrangements of magnetic cores. The post can be integrally formed as part of the housing 202, as disclosed in FIG. 3, or can alternatively be formed as a separate component that is affixed within the chamber 228 of the housing 202. The post 226 can be formed from a material such as plastic. The physical positioning in the x-y plane of the magnetic cores due to the configuration, orientation, and position of the post 226 can help to avoid electromagnetic interference (EMI) and reduce cross-talk.

Another example of a structural implementation of a means for positioning the magnetic cores is a barrier 230. In one example embodiment, the barrier 230 can be a flat piece of plastic or other dielectric material with an outside diameter that is substantially the same size and shape as the inside diameter of the chamber 228. The barrier 230 can have a perforation 232 corresponding to the size and location of the post 226. The barrier 230 can then be located between each layer of four magnetic cores 224 that are situated around the post 226. The physical positioning in the z-direction of the magnetic cores because of the barrier 230 can help to avoid electromagnetic interference (EMI) and reduce cross-talk.

It is noted that a variety of means may be employed to perform the functions disclosed herein concerning the positioning of the magnetic cores 200. Thus, the configurations of the post 226 and the barrier 230 comprise but two example structural implementations of means for positioning the magnetic cores 224. Accordingly, it should be understood that such structural implementations are disclosed herein solely by way of example and should not be construed as limiting the scope of the present invention in any way. Rather, any other structure or combination of structures effective in implementing the functionality disclosed herein may likewise be employed.

By way of example, in some embodiments of the connector structure 200, the post 226 can have a circular cross-section or a cross-section resembling a variety of non-circular shapes including, but not limited to, a rectangle, oval, triangle, pentagon, polygon, or cross. Similarly, the chamber 228 and/or the barrier 230 can have a substantially rectangular cross-section, as disclosed in FIG. 3, or alternatively can have a cross-section resembling a variety of other shapes including, but not limited to, a rectangle, oval, triangle, pentagon, polygon, or cross. In addition, neither the post 226 nor the chamber 228 nor the barrier 230 need have a uniform cross sectional shape or cross-sectional size along their respective lengths. The cross-sectional shape may change, therefore, along the length of the post 226, the chamber 228, and or the barrier 230. In addition, in some example embodiments of the connector structure 200, the post 226 can be accompanied by one or more additional posts, configured as disclosed herein.

Figure 4:
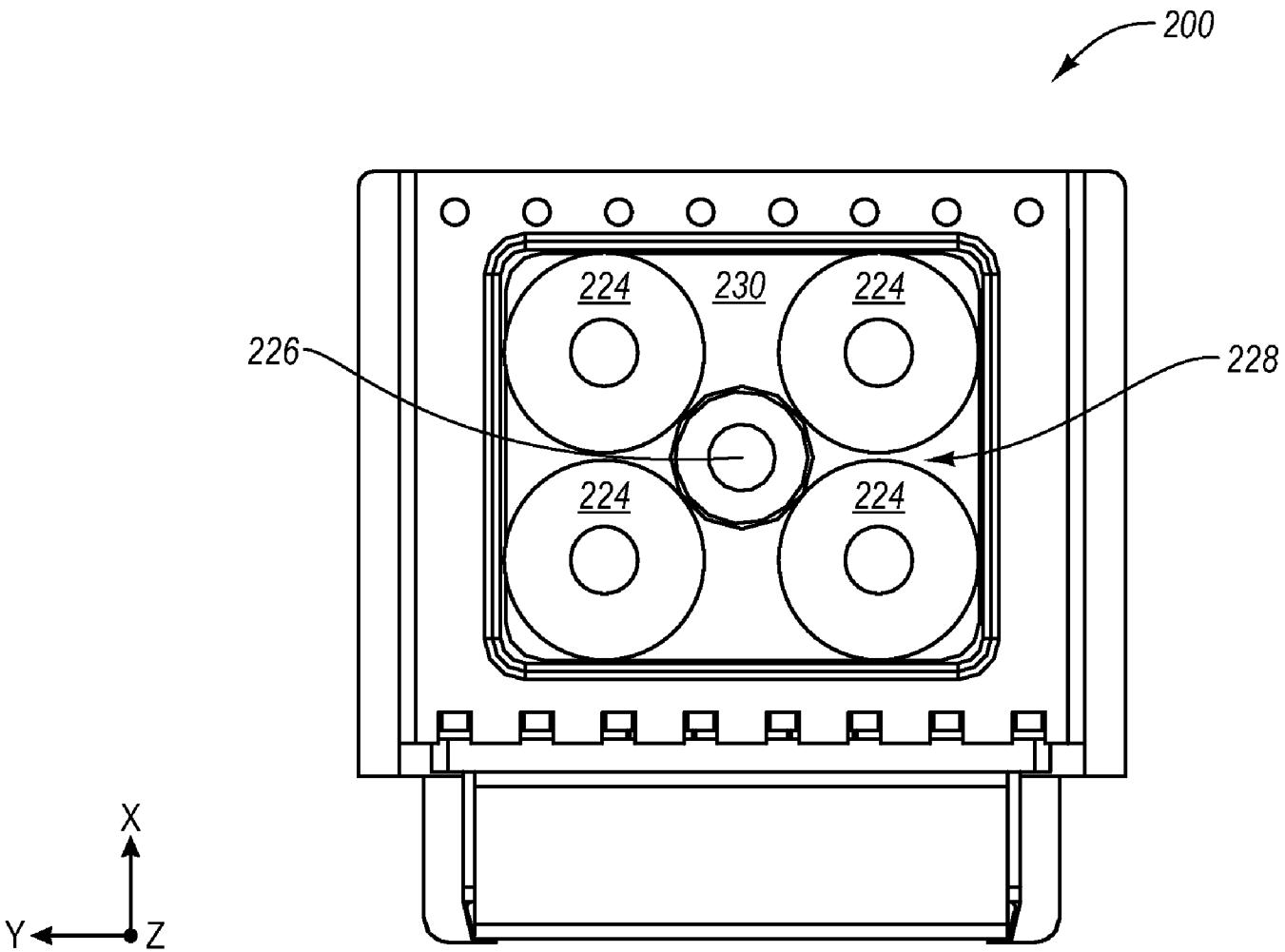
FIG. 4 is a rear view of the connector structure of FIG. 3.

The magnetic cores 224 are sized and configured to be positioned within the chamber 228. With continuing reference to FIG. 3, and with reference now also to FIG. 4, additional aspects of the housing 202, magnetic cores 224, and post 226 are disclosed. When the magnetic cores 224 are positioned within the chamber 228, as shown in FIG. 4, the exact position of each pair of magnetic cores 224 (with each magnetic core in a "pair" having the same x-coordinate and y-coordinate but different x-coordinates) is at least partially determined by the position of the post 226. In other words, during the assembly of the connector structure 200, the size, geometry, location and orientation of the post 226 are such that each pair of magnetic cores 224 is positioned and located in a desired portion of the chamber 228.

In one embodiment, all the pairs of magnetic cores 224 are substantially symmetrically arranged in the x-y plane around the post 226, although non-symmetrical positioning of the magnetic cores 224 is also contemplated. In some example embodiments, the post 226 facilitates the placement of each pair of magnetic cores 224 such that each pair may, or may not, be physically separated from one or more other pairs. For example, the post 226 may facilitate the placement of each pair of magnetic cores 224 such that each pair is physically separated from, and not in physical contact with, any other pair, as disclosed in FIG. 4. In another example, the post 226 may facilitate the placement of each pair of magnetic cores 224 such that each pair is physically separated from, and not in physical contact with, at least one other pair, while each pair is in physical contact with one or more other pairs. Although cross-talk may generally be minimized as the magnetic cores 224 are placed as far apart as possible from each other, cross-talk may remain at acceptably low levels in some cases where one or more of the magnetic cores are in physical contact. It is noted that cross-talk levels may also be a function of other variables as well, such as signal data rate.

As disclosed in FIG. 4, the post 226 causes, for example, the upper right hand pair of magnetic cores 224 to be positioned as far apart as possible from the lower-left hand pair of magnetic cores 224. In addition, each individual magnetic core 224 of each pair of magnetic cores 224 may be electrically isolated from its mate by the barrier 230. In this example, the barrier 230 is located between the two layers of four magnetic cores 224 that are situated around the post 226.

The relatively precise placement of each pair of magnetic cores 224 that is caused by the post 226 may also result in an improved BER performance and space utilization with the module 100. For example, the post 226 may enable relatively consistent and repeatable positioning and spacing of the magnetic cores 224 when compared to the positioning and spacing achievable absent the post 226. Also, in one particular example, the connector structure 200 and the base 102 make effective use of the finite volume of space allowed for the host port portion by the SFP Transceiver MSA package dimension constraints. Specifically, the connector structure 200 and base 102 are shaped such that the magnetic cores 224 can all be housed within the connector structure 200, which in turn is housed within the connector portion 112 of base 102. This negates the need to locate some or all of the magnetic cores 224 on the printed circuit board 104, which in turn provides relatively more space on the printed circuit board 104 for the placement of electronic components 120.

This relative increase in usable volume within the module 100 is also made possible in part because of the efficient use of space by the latch mechanism 108. Other latch mechanisms on other electrical SFP transceiver modules cause the conductive elements of the RJ-45 jack of the SFP transceiver module to sit higher within the RJ-45 jack, which results in less space to stack magnetic cores in the connector structure of the SFP transceiver module.

More particularly, in electrical SFP transceiver modules designed to operate in temperature ranges from −40° C. to 85° C., which necessitates larger magnetic cores than, for example, electrical SFP transceiver modules designed operate in temperature ranges from 0° C. to 70° C., the connector structure 200 and the base 102 allow eight magnetic cores to be positioned within the connector portion 112 of the base 102. As disclosed previously, this positioning of eight magnetic cores in the connector portion 112 of the base 102 allows for more available space for electronic components on the one or more printed circuit boards within the module 100. For example, the efficient use of available space in the module 100 can allow for additional electronic components, such as additional jump resistors, which in turn allows for additional features and configuration options in the module 100. The post 226 contributes to this efficient use of space by improving the yield of modules with acceptably low BERs.

The example embodiments disclosed herein are to be considered in all respects only as illustrative and not restrictive.

What is claimed is:

1. A connector structure comprising:

a housing that defines a chamber;

a plurality of magnetic cores positioned within the chamber; and a means for positioning the plurality of magnetic cores so that first and second magnetic cores of the plurality of magnetic cores are not in physical contact with a third and fourth magnetic cores of the plurality of magnetic cores, the first and third magnetic cores having substantially the same x-y position but having distinct z positions within the chamber, the second and fourth magnetic cores having substantially the same x-y position but having distinct z positions within the chamber, the first and second magnetic cores having substantially the same y-z position within the chamber, and the third and fourth magnetic cores having substantially the same y-z position within the chamber.

2. The connector structure as recited in claim 1, further comprising:

a first set of conductive elements connected to the housing; and a second set of conductive elements connected to the housing.

3. The connector structure as recited in claim 2, further comprising:

a printed circuit board that defines first, second, and third sets of plated through holes, wherein each of the first set of plated through holes is electrically connected to one of the first set of conductive elements, and wherein each of the second set of plated through holes is electrically connected to one of the second set of conductive elements.

4. The connector structure as recited in claim 3, further comprising a flexible ribbon comprising a third set of conductive elements, wherein each of the third set of conductive elements is electrically connected to a plated through hole of the third set of plated through holes.

5. The connector structure as recited in claim 4, wherein the first set of conductive elements is configured to electrically connect with a corresponding set of electrical elements of an RJ-45 plug.

6. A module comprising:

a base comprising a host port portion and a connector portion, the host port portion substantially complying with SFP Transceiver MSA package dimensions;

a second printed circuit board positioned within the host port portion; and the connector structure as recited in claim 5 positioned within the connector portion, a fourth set of conductive elements of the flexible ribbon of the connector structure in electrical communication with the second printed circuit board.

7. The module as recited in claim 6, wherein the means for positioning facilitates control of a bit error rate in the module.

8. The module as recited in claim 6, wherein the means for positioning facilitates control of cross-talk in the module.

9. A connector structure comprising:

a housing that defines a chamber;

a plurality of magnetic cores positioned within the chamber;

a structure positioned between a first magnetic core and a second magnetic core of the plurality of magnetic cores and configured such that the first magnetic core is not in physical contact with the second magnetic core; and a barrier having a perforation in which the structure is received, the barrier positioned between a pair of magnetic cores that are situated around the structure.

10. The connector structure as recited in claim 9, wherein the structure is substantially centrally located within the chamber in an x-y plane passing through the chamber.

11. The connector structure as recited in claim 9, wherein the structure is integrally formed as part of the housing.

12. The connector structure as recited in claim 9, wherein the magnetic cores are substantially symmetrically arranged around the structure within the chamber.

13. An electrical transceiver module comprising:

a base comprising a host port portion and a connector portion, the host port portion substantially complying with SFP Transceiver MSA package dimensions;

a printed circuit board positioned within the host port portion; and the connector structure as recited in claim 9 positioned within the connector portion, conductive elements of the connector structure in electrical communication with the printed circuit board, the connector structure configured to physically and electrically interface with an RJ-45 plug.

14. An electrical transceiver module comprising:

a base comprising a host port portion connected to a connector portion, the host port portion substantially complying with SFP Transceiver MSA package dimensions;

a first printed circuit board positioned substantially within the host port portion; and a connector structure positioned substantially within the connector portion, the connector structure comprising:

a housing that defines a chamber;

a plurality of magnetic cores positioned within the chamber; and a post positioned between a first magnetic core and a second magnetic core of the plurality of magnetic cores and configured such that the first magnetic core is not in physical contact with the second magnetic core.

15. The electrical transceiver module as recited in claim 14, further comprising:

a first set of conductive elements connected to the housing, the first set of conductive elements configured to electrically connect with a corresponding set of electrical elements on an RJ-45 plug;

a second set of conductive elements connected to the housing;

a flexible ribbon comprising third and fourth sets of conductive elements; and a second printed circuit board that defines first, second, and third sets of plated through holes, the plated through holes and conductive elements being arranged such that each of the first set of plated through holes is electrically connected to one of the first set of conductive elements, each of the second set of plated through holes is electrically connected to one of the second set of conductive elements, each of the third set of plated through holes is electrically connected to one of the third set of conductive elements, and each of the fourth set of conductive elements is electrically connected to the first printed circuit board.

16. The electrical transceiver module as recited in claim 15, wherein each of the fourth set of conductive elements is electrically connected to one of a fourth set of plated through holes defined in the first printed circuit board.

17. The electrical transceiver module as recited in claim 14, wherein the post is substantially centrally located within the chamber in an x-y plane passing through the chamber.

18. The electrical transceiver module as recited in claim 14, wherein the magnetic cores are substantially symmetrically arranged around the post within the chamber, and at least two of the magnetic cores reside in a common x-y plane that passes through the chamber.

19. The electrical transceiver module as recited in claim 14, further comprising a barrier having a perforation in which the post is received, the barrier positioned between a pair of magnetic cores that are situated around the post.

* * * * *